US007073303B2

(12) United States Patent
Baker

(10) Patent No.: US 7,073,303 B2
(45) Date of Patent: Jul. 11, 2006

(54) STRUCTURE AND METHOD FOR INTERCONNECTING CONSTRUCTION UNITS MADE FROM COMPOSITE MATERIALS

(75) Inventor: Charles Baker, Lenexa, KS (US)

(73) Assignee: Elk Composite Building Products, Dallas, TX (US)

( * ) Notice: Subject to any disclaimer, the term of this patent is extended or adjusted under 35 U.S.C. 154(b) by 0 days.

(21) Appl. No.: 10/232,189

(22) Filed: Aug. 28, 2002

(65) Prior Publication Data

US 2004/0040244 A1 Mar. 4, 2004

(51) Int. Cl.
*E04B 2/46* (2006.01)

(52) U.S. Cl. ..... 52/586.1; 52/582.1; 52/586.2; 52/592.1; 52/509; 52/512

(58) Field of Classification Search ..... 52/582.1, 52/586.1, 586.2, 585.1, 592.1, 584.1, 508, 52/509, 512, 489.1, 650.3
See application file for complete search history.

(56) References Cited

U.S. PATENT DOCUMENTS

| | | | | | |
|---|---|---|---|---|---|
| 363,960 | A * | 5/1887 | Jensen | 52/512 |
| 2,362,252 | A * | 11/1944 | Ellinwood | 52/288.1 |
| 4,198,042 | A * | 4/1980 | Olson | 472/92 |
| 4,449,346 | A * | 5/1984 | Tremblay | 52/509 |
| 5,660,016 | A * | 8/1997 | Erwin et al. | 52/483.1 |
| 5,881,508 | A * | 3/1999 | Irvine et al. | 52/177 |
| 5,953,878 | A * | 9/1999 | Johnson | 52/582.2 |
| 6,314,699 | B1 * | 11/2001 | West | 52/489.1 |
| 6,363,677 | B1 * | 4/2002 | Chen et al. | 52/586.1 |
| 6,484,467 | B1 * | 11/2002 | Crout | 52/483.1 |
| 6,490,838 | B1 * | 12/2002 | Summerford | 52/650.3 |
| 6,579,605 | B1 * | 6/2003 | Zehner | 428/319.9 |
| 6,651,398 | B1 * | 11/2003 | Gregori | 52/489.1 |
| 2002/0121064 | A1 * | 9/2002 | Erwin | 52/586.1 |
| 2003/0101673 | A1 * | 6/2003 | West et al. | 52/489.1 |
| 2003/0154662 | A1 * | 8/2003 | Bruchu et al. | 52/87 |

* cited by examiner

*Primary Examiner*—Carl D. Friedman
*Assistant Examiner*—Abdul Manaf
(74) *Attorney, Agent, or Firm*—Baker Botts LLP

(57) ABSTRACT

The invention contemplates a system of interconnecting notched composite articles so as to create a surface therefrom. A joint segment having an edge configured to be received into a plurality of notches within juxtaposed composite articles and a fastener engaging the joint segment so as to anchor the joint segment to a support system underlying the joint segment interconnects the composite articles. Further disclosed is a method of installing composite articles involving fastening a first joint segment having opposing edges to a structural support system, aligning a composite article having a first notch on at least a portion of a first surface of the composite article and a second notch on a second surface of the composite article such that the first joint segment edge is received into the first notch, and fastening a second joint segment having edges to the structural support system such that the second joint segment edges engages the second notch on the second surface of the composite article.

22 Claims, 5 Drawing Sheets

STRUCTURE AND METHOD FOR INTERCONNECTING CONSTRUCTION UNITS MADE FROM COMPOSITE MATERIALS

FIELD OF INVENTION

The present invention relates to an assembly system for interconnecting construction units fashioned from polymer/fiber composite materials, and an installation method related thereto.

BACKGROUND OF THE INVENTION

Wood has long been milled for use in fabricating structural or decorative components in building and construction applications. Wood, however, while structurally strong, useful and well adapted for use in many residential and commercial situations, presents deterioration problems under certain circumstances. Also, stronger woods are considerably denser than weaker woods, and as a result, tend to be very heavy. Yet, many construction applications benefit from the use of construction materials that minimize weight and maximize strength. Materials such as fiberglass or carbon fibers are available that are both stronger and lighter than hard woods. Although these materials combine superior strength with light weight, their cost can be prohibitive, making them useful only in high value situations and not cost effective in normal wood replacement type applications.

Consequently, using light weight yet sufficiently strong composite materials (such as those disclosed in U.S. patent application Ser. No. 09/706,590, now abandoned, which is hereby incorporated by reference) to manufacture construction units for building applications is desirable. Because manufacture of composite material construction units may be specialized so as to maximize certain desirable properties, such as softness, hardness, durability and other qualities, traditional means of anchoring and interconnecting such units, such as by perforation or boring with a nail, anchor and or screw, may not be appropriate and may unnecessarily damage the material. Such use of perforation and/or boring type fasteners may also be unsightly and the fasteners may, over time, protrude out from the planar surface of the resulting assembled structure. Therefore, systems of assembling, interconnecting and/or fastening discreet construction units, such as planks, panels and boards, made of composite materials, that will complement the composite material, and not split, warp or otherwise harm the units, are desirable For instance, one particular application of composite materials is in the building of outdoor decks. For such applications, other fastening systems have been previously developed that deviate from the traditional nail, screw and other perforation or boring types of fastening. Steel straps, for instance, may be used to hold boards together from the underside. Such systems, however, are both cumbersome to install and to maintain. Other underside type fastening systems, such as those using tongue and groove type interconnections, may require heavily specialized design, manufacture, tooling and shaping, as well as specialized fabrication techniques, increasing the cost of the unit. This type of construction may also impede proper drainage of the surface area.

Other systems attempted include using biscuit cutters (e.g., tools that can impart a circular shaped groove in a decking board) to cut a circular shaped hole, depression or groove in the decking board over a support joist. These holes receive a circular fastener that is then fastened to the support joist (for instance, by a screw). Again, however, such holes and the screws used in them may be unsightly, and may eventually protrude over time.

What is needed is a system for assembling and interconnecting composite material construction units that complements the durability of the composite materials used and that also is sufficiently hidden from the casual viewer so as to not detract from the color and beauty of the finished structure.

SUMMARY OF THE INVENTION

The invention is directed to a system for fastening a construction unit made of a composite material comprising a fiber material and a thermoplastic. This includes use of a joint segment with protruding edges configured to be received into notches made in the construction unit.

With respect to the construction unit, the fiber material may be wood, fiberglass, agricultural by-products, industrial by-products or any other material having a durable wood- or fiber-like consistency. The fiber material can also be a mixture of different fibers, such as wood and fiberglass, wood and agricultural by-products. The thermoplastic material of the composite material may be polyethylene or polypropylene. This material aids in binding the fiber material together so as to form a strong, durable article of manufacture. In this process, the thermoplastic material shrinks to grip the fiber material so as to hold the fiber material in place, as the thermoplastic cools.

The construction unit produced is durable, strong, and long lasting. These characteristics make the article of manufacture a good replacement for wood, and other structural and decorative materials in places where conditions are extreme and other materials have a short life span. For example, the construction units can be used in the construction of decks, floors, sidewalls in railcars, trucks and trailers as well as fences and residential home construction.

As such, disclosed is a structure of interconnecting composite material construction units, the structure having an approximately uniform planar surface including a first composite material construction unit having a surface defining a notch, a second composite material construction unit having a surface defining a notch, the second composite material construction unit surface juxtaposed to the surface of the first construction unit, and a joint segment having two substantially opposing edges, the edges having gripping means, the first edge received within the first composite material construction unit notch and the first edge gripping means contacting the first composite material construction unit surface, the second edge received within the second composite material construction unit notch and the second edge gripping means contacting the second composite material construction unit surface.

Also disclosed is an article of manufacture comprising interconnection means and a composite article comprising a fiber material and a thermoplastic material, the composite article having a surface defining a notch for receiving and holding the interconnection means.

Also disclosed is a method of interconnecting composite material construction units having an approximately uniform planar surface. The method involves providing a first composite material construction unit having a surface defining a notch with a slotted portion, juxtaposing a second composite material construction unit having a surface defining a notch with a slotted portion to the surface of the first construction unit, and contacting a joint segment having two opposing edges, the edges having gripping means, with the first composite material construction unit and the second composite material construction unit. The contacting is done such that the joint segment first edge is received within the first composite material construction unit notch and the first edge gripping means contacting the first composite material construction unit surface, the second edge is received within the second composite material construction unit notch and the second edge gripping means contacting the second composite material construction unit surface.

DETAILED DESCRIPTION OF THE INVENTION

The present invention is directed to a fastening system used in conjunction with composite article construction units comprising a fiber material and a thermoplastic material. The composite article is described in application Ser. No. 09/706,590 filed on Nov. 6, 2000, now abandoned, the specification of which is incorporated herein by reference. As used herein, the term "thermoplastic" has the same scope of meaning as "thermal plastic" as used in the application.

The composite article comprises a fiber material and a thermoplastic material. The fiber material may be wood, fiberglass, agricultural by-products, industrial by-products or any other material having a durable wood- or fiber-like consistency. The fiber materials can also be a mixture of different fibers, such as wood and fiberglass, or wood and agricultural by-products. The thermoplastic material of the composite material may be polyethylene or polypropylene. This material aids in binding the fiber material together so as to form a strong, durable article of manufacture. The thermoplastic material shrinks to grip the fiber material so as to hold the fiber material in place.

The composite material is fashioned, for instance, by extrusion, into articles comprising construction units used to assemble and/or construct a structure. The units may be boards, slats, planking, decking, panels, or other discreet units that are interconnected so as to form the structure desired, such as a residential deck, or a portion thereof, for instance, a stairway or ramp access point for a structure. Various shapes and styles for the composite material construction units and their interconnection are contemplated according to numerous different types of uses and applications for nearly all forms of construction and building. Interconnection of two or more of the composite article construction units according to the preferred embodiment of the invention will yield a substantially uniform planar surface. That surface may or may not be affixed to a structural support system, such as floor joists, posts or wall studs.

Figure 1:
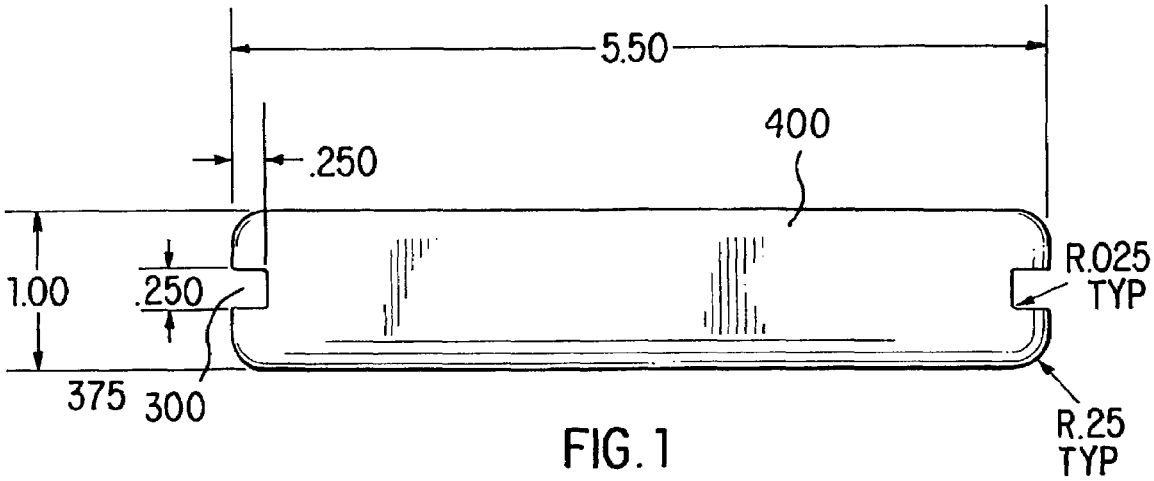
FIG. 1 shows a cross section of an exemplary board shaped construction unit having notches.

FIG. 1 illustrates a cross section of an extruded composite material construction unit of a board type. During extrusion, or other manufacturing process used to create the construction unit, a notch 300 in at least one surface of board 400, is made. Notch 300 may extend a predetermined distance over board 400 along the board surface. As described herein, the surface of board 400 wherein the notch extends is understood to encompass the entire surface area defined by the notch, including internal notch dimensions and configurations.

At least a portion or segment of notch 300 is located at a point where the unit is to be interconnected with other construction units to comprise a structure, for instance a deck or wall. As used herein, notch 300 is an exemplary configuration and the invention contemplates other gaps or spaces, such as grooves, holes, slots, apertures or other similar features on or within the construction unit.

Dimensions and placement of the notches are according to the design dictates of the particular composite material construction unit. For example, in a 1 inch width board used as a construction unit for residential decking, the notch may be placed approximately ⅜ inches from both the upper and lower edges; the notch itself may be ¼ inches wide. In this example, the notches are a recessed portion forming a continuous channel defined by at least one surface of the construction unit and extending at least a portion of the linear or diagonal dimensions, e.g. length and/or width, of that surface, the surface also encompassing the recessed dimensions of the notches. This resulting channel is configured to receive an interconnection means which may be a pin, joint or other piece so as to connect, fasten and/or anchor the construction unit to other units and/or to a fixed point that may be a structural support system, such as a floor joist, wall stud, or post. In the preferred embodiment, a joint segment having edges is configured to be received in notch 300.

The notches within the construction unit surface can also be formed by molding or other ways known to the trade, such as milling. Preferably, the notch is formed in the construction unit at the time the unit is manufactured, for instance using a forming die, and optionally, a heated mandrel, to impart the notch shape used during extrusion of the composite material to form the construction unit. The illustrated notches 300 of the embodiment in FIG. 1 are only one manner in which the notches can be configured; their shape can be altered as required by 1) the strength, hardness or other quality of the composite material, in this embodiment, the board; and/or 2) by the desired fit or joint to be used to fasten the article to another article, for instance, jagged edged, rounded, slanted, angled or other orientations and shapes may be used.

Notches 300 are preferably employed in conjunction with interconnection means, which may be an insertable piece, for instance, a joint segment, that will connect the construction unit to other units. Notch size, for instance, depth and width, and internal dimensions, as well as inclusion of a lip, flange, slot, clip or other type of structure to engage corresponding gripping means on an insertable piece, will preferably also be determined by the type of piece to be inserted, in order to properly space the construction units during their assembly.

The notches can have any applicable dimensions to accommodate the particular interconnection means used. As illustrated by the embodiment in FIG. 1, the applicable dimensions for a board with a 5.5 inch width and a 1.0 inch height, may be a 0.250 inch opening, extending 0.250 inches into board 400. The notch 300 may be situated at about the center of a surface of board 400, as shown in FIG. 1. Other locations for the notch along the same or other surfaces of the construction unit also would occur to those of skill in the art.

Figure 2:
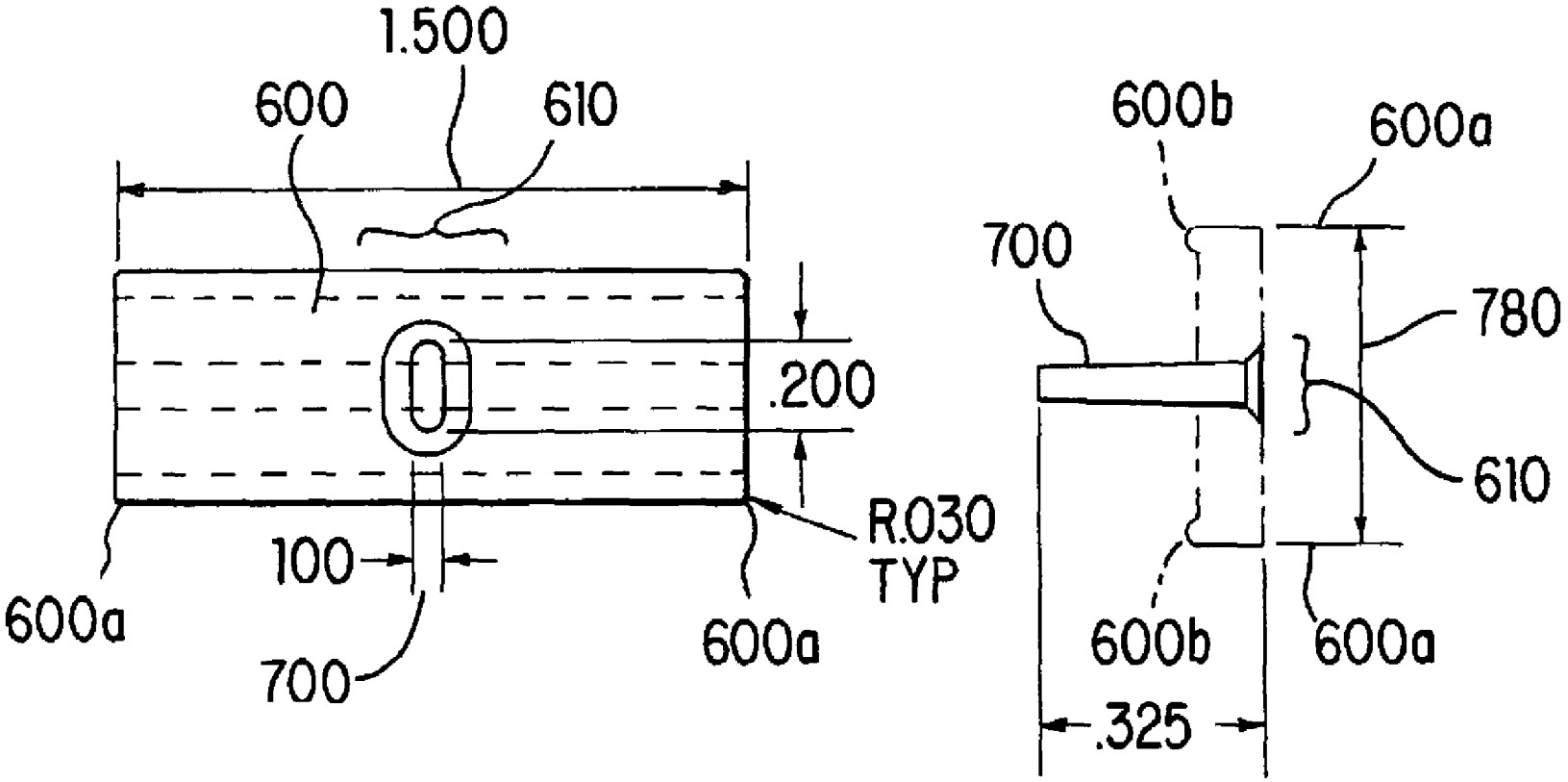
FIG. 2*a* and FIG. 2*b* show diagrams of a joint segment used of one embodiment of the invention.

In the preferred embodiment, the interconnection means used is a piece or item that engages at least one notch of a construction unit, such as a board. The interconnection means may engage the notches ofjuxtaposed construction units so as to interconnect them. Interconnection of a plurality of construction units so as to form a substantially planar surface may thus be accomplished. FIG. 2*a* and FIG. 2*b* illustrate one embodiment wherein a joint segment 600 having substantially opposing edges 600*a* is configured to be received into notches, such as those notches 300 illustrated in FIG. 1. These edges 600*a* may be in linear opposition (as shown in FIG. 2*b*) or, alternatively, may be spaced, angled or raised, depending on the dictates of the particular construction application or aesthetic look sought. Joint segment edges 600*a* are inserted within juxtaposed notches 300 on two construction units and attach the articles in a suitable alignment, which may be side by side over a vertical or horizontal surface area, such as with floor boards, fence rails, or deck boards. Gripping means, such as clip portions 600*b*, are configured to contact the surface within notches 300 to grip and hold the construction unit. Other gripping means, such as other interlocking devices, clips, fasteners, pins, slots or hook and loop type devices and corresponding slots, clips, hooks or other fastening devices included within notches 300 to engage the gripping means used are also within the scope and contemplation of the invention.

The interconnection means may interconnect the construction units by engaging a sequence of juxtaposed notches on two or more construction units to form an extended substantially planar surface composed of a plurality of interconnected construction units. Preferably, joint segment 600 contacts a building support system and joint segment 600 also includes a center surface area 610, for instance, located in an area between the substantially opposing edges, 600*a*, sufficient in size and thickness to receive a nail, screw or other fastener that will engage a structural support system, for instance, a floor joist, wall stud or post, and so be anchored. Repeated interconnection of construction units through anchored joint segments in this regard forms a structure with a substantially planar surface, for instance a deck, floor or wall, although it is within the scope and contemplation of the invention that the construction unit may be interconnected, by joint segment and notch, to other units made of wood, steel or other construction materials.

Joint segment 600 is preferably made of a hard thermoplastic material, such as a high impact injection molded nylon or polyester or a polypropylene or polyethylene with hardening additives, which also may be injection molded. In one embodiment, the thermoplastic material is a high impact polypropylene such as A7234 available from Amoco Corporation. In the preferred embodiment, joint segment 600 has a balance of hardness and flexibility sufficient to hold a screw or other fastener without the fastener pulling through while minimizing the potential for splitting or cracking. Its size and dimensions will depend upon the particular composite material construction unit it will be used to interconnect. In the illustrated embodiment, for use with a 1 inch high, 5.5 inch wide board, joint segment may be 1.5 inches long and 0.78 inches wide.

Figure 3:
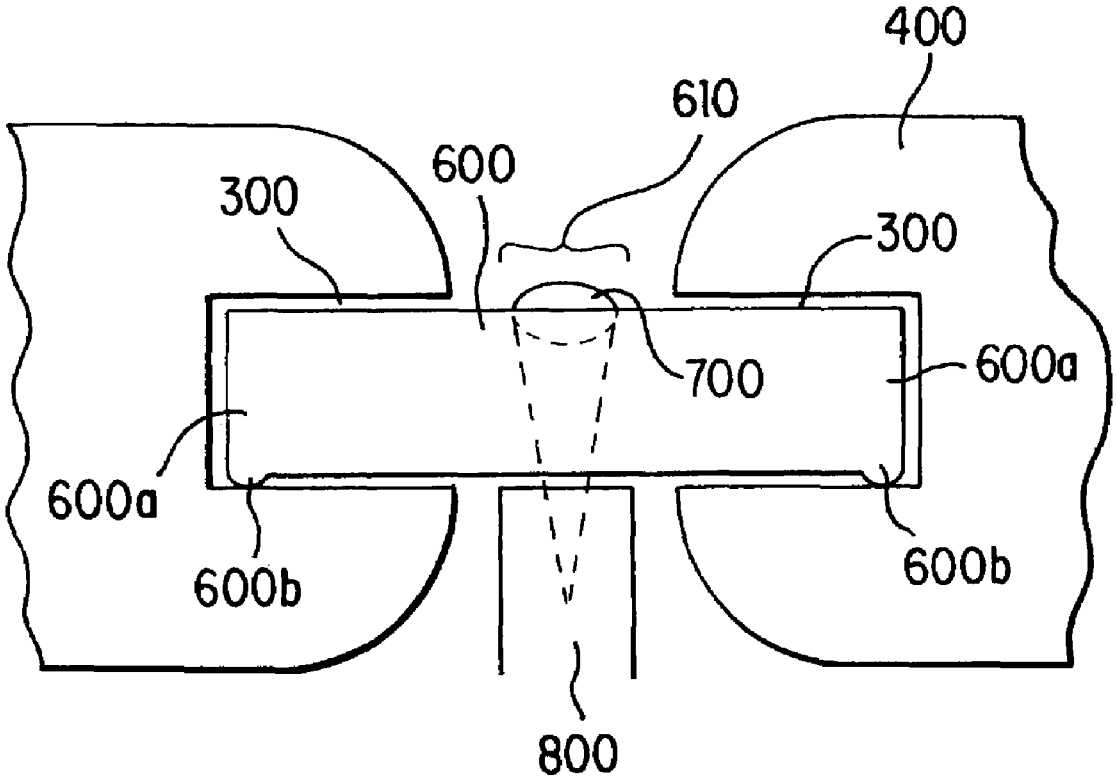
FIG. 3*a* and FIG. 3*b* show cross section diagrams of one embodiment of the invention illustrating a joint segment engaging the notches of two juxtaposed board shaped construction units.

FIG. 3*a* and FIG. 3*b* illustrate one embodiment of the invention interconnecting two composite material boards, 400. Joint segment 600 contacts floor joist 800, and fastener 700, for instance a screw, extends through joint segment 600 into floor joist 800. Thus anchored, the joint segment edges 600a engage notches 300 of boards 400 and clip portions 600b contact the surface of notch 300. Where a joint segment 600 with clip portion 600*b* at edges 600*a*, is inserted into notch 300 and is anchored by a fastener into a structural support system, this anchoring also exerts pressure on the clip portion 600*b* contacting the surface of board 400 within notch 300. In the illustrated embodiment, the clip portions 600*b* contacting the surface within notch 300 creates a space therebetween. Joint segment 600 may be fashioned of a sufficiently elastic material, such as a thermoplastic, to resiliently contort, compressing central surface area 610 when fastener 700 is anchored, extending the center surface area 610 slightly into the space between clip portions 600*b* where clip portions 600*b* are edges 600*a*, bend in opposition to central surface area within notch 300. Where the notch surface is sufficiently narrow to oppose such opposing movement by clip portions 600*b* and edges 600*a*, these contact and press against the notch surface, increasing the grip of joint segment 600 within notch 300.

Clip portions 600*b* are one example of a gripping means deployable within the notches to provide a structure by which to grip and hold an interconnection means, other examples, including corresponding clip members within the notch and other fastening mechanisms are within the scope and contemplation of the invention.

Figure 4:
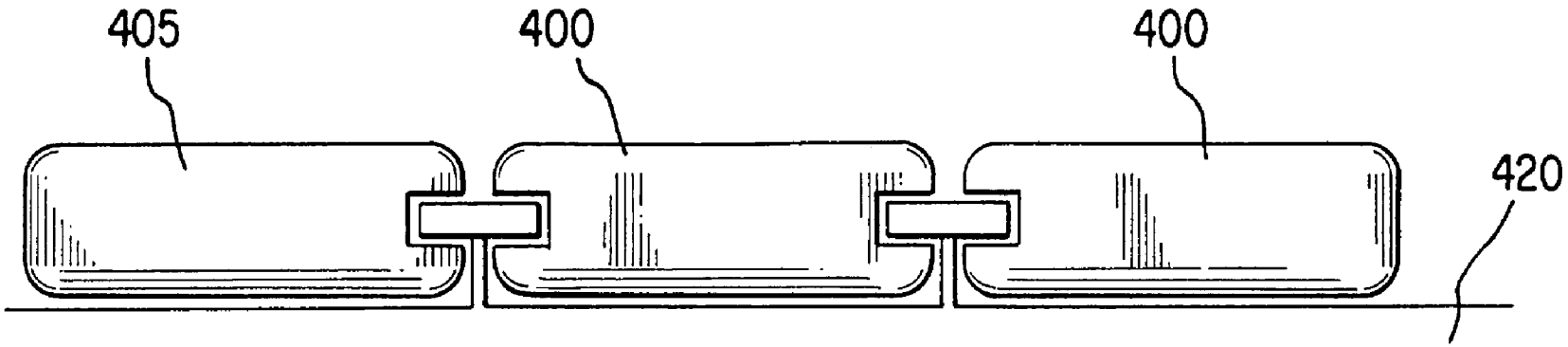
FIG. 4 shows a cross-section diagram of multiple interconnected construction units of one embodiment of the invention.

FIG. 4 illustrates the interconnection system as it connects a series of construction unit boards 400 arrayed over an area or surface 420. These include boards 405 that may include only one notch, on only one surface thereof, and thus serve as starter or end pieces where the interconnection pattern begins and/or terminates, for instance, at a wall or other extremity of the area to be encompassed by the system. Depending on the structure, two boards or panels, each with only one notch, may be interconnected to form a desired feature, such as a step or gate.

Figure 5:
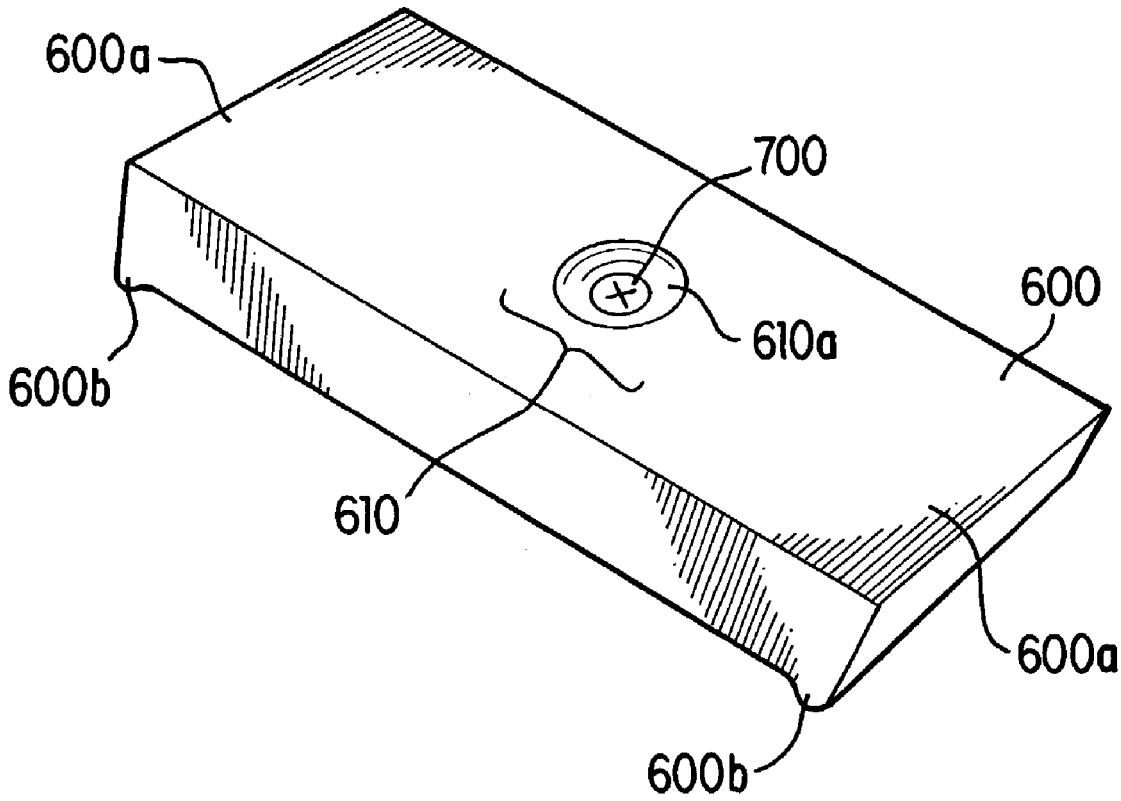
FIG. 5 shows a perspective diagram of a joint segment used for interconnecting construction units according to one embodiment of the invention.

FIG. 5 illustrates a joint segment 600 for receiving a fastener 700, in this embodiment a screw. Joint segment 600 center surface area 610, between the opposing edges 600*a*, defines a hole 610*a* extending through joint segment 600 to receive fastener 700 to fasten joint segment 600 to a structural support system, for instance a floor joist, post or wall stud. Center surface 610 is of sufficiently large area and comprises a sufficiently strong, yet flexible, material (for instance, plastic material such as polypropylene) to absorb and distribute the pressure exerted by the fastener extending through hole 610*a* and not deform, thus preventing the fastener (here a screw) from pulling through the joint segment when mechanically installed. In this embodiment, joint segment 600 edges 600*a* include into clip portions 600*b* for contacting the construction unit surface within notch 300, as has been described above. When anchored to a structural support system, the clip portions 600*b* and the elasticity of joint segment 600 creates a gripping effect within notch 300. As a fastener, such as 700, compresses central surface area 610 downward into the lateral space defined between clip portions 600*b* and toward the structural support system, edges 600*a* become slightly elevated within notch 300 such that the edges 600*a* contact notch 300 surface, compressing edges 600*a* and clip portions 600*b* within the notch to increase gripping.

The invention also contemplates a method of installation of composite articles using the fastener system disclosed. The method involves placing a first composite material construction unit having a surface defining a notch in a suitable position, e.g. on an area where a surface is to be constructed. Next, juxtaposing a second composite material construction unit having a surface defining a notch to the surface of the first construction unit. The interconnection of the composite material construction units is done by contacting a joint segment having two opposing edges, each edge having gripping means, with the first composite material construction unit and the second composite material construction unit such that the joint segment first edge is received within the first composite material construction unit notch and the first edge gripping means contacts the first composite material construction unit surface. The second edge is received within the second composite material construction unit notch and the second edge gripping means contacts the second composite material construction unit surface.

If the interconnected surface is to be anchored to a structural support system, such as a floor joist, post or wall stud, the joint segment is connected to the structural support system with a fastener, for instance, by applying the fastener through the joint segment surface hole.

The method can be repeated for additional interconnected construction units, as such, by juxtaposing a third composite material construction unit having a surface defining a notch, to the second surface of the second construction unit and contacting a second joint segment with two opposing edges, the edges having gripping means, with the second composite material construction unit and the third composite material construction unit such that the second joint segment first edge is received within the second composite material construction unit second surface notch and the first edge gripping means contacts the second composite material construction unit second surface notch, the second joint segment second edge is received within the third composite material construction unit notch and the second joint segment second edge gripping means contacts the third composite material construction unit surface. Similarly, the second joint segment is anchored to a structural support system with a fastener. Thus, a succession of construction units are interconnected over a gradually larger substantially planar surface area.

Although the above described embodiments illustrated in the Figures show a side by side interconnection assembly, other assembly types using other construction units are within the scope and contemplation of the invention. For instance, a joint segment with edges may be used to interconnect panel or square type construction units in a checkerboard or parquet pattern. It should be stressed that vertically oriented assemblies such as paneling, walls or fences may also be constructed using suitable construction units and vertically oriented joints interconnecting slats, planks, boards, pickets or other types of construction units.

The construction unit, such as a board, may also be notched so as to receive a greater surface area of the joint edge, thus placing the boards closer together and obscuring the joint and the fastening means used therethrough, such as a nail, screw or other fastener anchoring the joint to the support system. Alternatively, the boards may be configured to allow more surface area of the joint to show, including the head of the fastener anchoring it to the support system, to allow for ease of removal, beneficial for temporary structures. Other configurations will occur to those of skill in the art as particular space and design requirements, as well as aesthetic demands, may dictate.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiment and modes of practice.

What is claimed is:

1. An article of manufacture comprising:

elastic interconnection means capable of being anchored to a support system;

a composite article comprising a fiber material and a thermoplastic material, the composite article having a surface defining a notch for receiving and holding the elastic interconnection means, said notch having an upper and lower surface, wherein the elastic interconnection means deforms within the notch upon anchoring of the interconnection means to the support system so that contact occurs between the interconnection means and the upper and lower notch surfaces.

2. The article of manufacture of claim 1 wherein the fiber material is one of wood, fiberglass, carbon fibers, and a mixture of two or more of wood, carbon fibers and fiberglass.

3. The article of manufacture of claim 1 wherein the thermoplastic material is selected from the group consisting of polypropylene and polyethylene.

4. The article of manufacture of claim 1 wherein the interconnection means is a first interconnection means and the notch is a first notch and the article further comprises a second surface defining a second notch for receiving and holding a second interconnection means.

5. The article of manufacture of claim 1, wherein the interconnection means comprises a joint segment having two substantially opposing edges, a first edge and a second edge, the edges having gripping means, wherein the notch receives the first edge and the lower surface contacts the first edge gripping means.

6. The article of manufacture of claim 5, wherein the gripping means comprises a clip portion.

7. The article of manufacture of claim 1, wherein the interconnection means comprises a high impact nylon, polyester, polyethylene or polypropylene.

8. The article of manufacture of claim 1, wherein the interconnection means defines a hole for receiving a fastener.

9. A structure of interconnecting composite material construction units, the structure having an approximately uniform planar surface comprising:

a first composite material construction unit having a surface defining a notch, said notch having an upper and lower surface;

a second composite material construction unit having a surface defining a notch, said notch having an upper and lower surface, the second composite material construction unit surface juxtaposed to the surface of the first construction unit; and an elastic joint segment capable of being anchored to a support system, said joint segment having two substantially opposing edges, a first edge and a second edge, the edges each having gripping means, the first edge received within the first composite material construction unit notch and the first edge gripping means contacting the lower surface of the first composite material construction unit notch, the second edge received within the second composite material construction unit notch and the second edge gripping means contacting the lower surface of the second composite material construction unit notch, wherein the elastic joint segment deforms within the first composite material construction unit notch and the second composite material construction unit notch upon anchoring of the joint segment to a support system so that contact occurs between the first edge of the joint segment and the upper and lower surfaces of the first composite material construction unit notch and between the second edge of the joint segment and the upper and lower surfaces of the second composite material construction unit notch.

10. The structure of claim 9, further comprising, a fastener connecting the joint segment to a structural support system.

11. The structure of claim 10, wherein the joint segment has a surface area defining an opening for receiving the fastener through the joint segment.

12. The structure of claim 9, wherein the second composite material construction unit surface is a first surface and the second composite material construction unit notch is first notch and the second composite material construction unit further defines a second surface defining a second notch, the system further comprising:

a third composite material construction unit having a surface defining a notch, the third composite material construction unit surface juxtaposed to the second surface of the second composite material construction unit; and a second joint segment having two substantially opposing edges, a first edge and a second edge, the edges each having gripping means, the second joint segment first edge received within the second composite material construction unit second surface notch and the first edge gripping means contacting the second composite material construction unit second surface, the second joint segment second edge received within the third composite material construction unit notch and the second joint segment second edge gripping means contacting the third composite material construction unit surface.

13. The structure of claim 12, further comprising a fastener engaging the second joint segment so as to anchor the second joint segment to a structural support system.

14. The structure of claim 9, wherein the joint segment edges gripping means comprises a clip portion.

15. The structure of claim 9, wherein at least one composite material construction unit is a board comprising one of polyethylene and polypropylene.

16. The structure of claim 9, wherein the joint segment comprises one of nylon and polypropylene.

17. A method of interconnecting composite material construction units having an approximately uniform planar surface comprising:

providing a first composite material construction unit having a surface defining a notch, said notch having an upper and lower surface;

juxtaposing a second composite material construction unit having a surface defining a notch, said notch having an upper and lower surface, to the surface of the first construction unit; and contacting an elastic joint segment capable of being anchored to a support system, said joint segment having two opposing edges, the edges having gripping means, with the first composite material construction unit and the second composite material construction unit such that the joint segment first edge is received within the first composite material construction unit notch and the first edge gripping means contacts the lower surface of the first composite material construction unit notch, and the second edge is received within the second composite material construction unit notch and the second edge gripping means contacts the lower surface of the second composite material construction unit notch, wherein the elastic joint segment deforms within the first composite material construction unit notch and the second composite material construction unit notch upon anchoring of the joint segment to a support system so that contact occurs between the first edge of the joint segment and the upper and lower surfaces of the first composite material construction unit notch and between the second edge of the joint segment and the upper and lower surfaces of the second composite material construction unit notch.

18. The method of claim 17, further comprising, anchoring the joint segment to a structural support system with a fastener.

19. The method of claim 18, wherein the joint segment has a surface area defining an opening for receiving the fastener through the joint segment.

20. The method of claim 17, wherein the second composite material construction unit surface is a first surface and the second construction unit comprises a second surface defining a notch, the method further comprising:

juxtaposing a third composite material construction unit having a surface defining a notch, to the second surface of the second construction unit; and contacting a second joint segment having two opposing edges, the edges having gripping means, with the second composite material construction unit and the third composite material construction unit such that the second joint segment first edge is received within the second composite material construction unit second surface notch and the first edge gripping means contacts the second composite material construction unit second surface, the second joint segment second edge is received within the third composite material construction unit notch and the second joint segment second edge gripping means contacts the third composite material construction unit surface.

21. The method of claim 20, further comprising anchoring the second joint segment to a support system with a fastener.

22. The method of claim 17, wherein the joint segment edges gripping means comprises a clip portion.

* * * * *